US005209268A

United States Patent [19]

Froment et al.

[11] Patent Number: 5,209,268

[45] Date of Patent: May 11, 1993

[54] SPACER DESIGN FOR DOBBY ROCKER MEMBERS

[75] Inventors: Jean Paul Froment, Doussard; Jean-Pierre Pages, Faverges, both of France

[73] Assignee: S.A. des Establissements Staubli, Faverges, France

[21] Appl. No.: 829,305

[22] Filed: Feb. 3, 1992

[30] Foreign Application Priority Data

Feb. 1, 1991 [FR] France ..... 91 01402

[51] Int. Cl.[5] ..... D03C 1/00

[52] U.S. Cl. ..... 139/66 A; 74/42; 74/599; 139/71

[58] Field of Search ..... 74/599, 42, 519; 29/433, 434; 139/66 R, 66 A, 69, 71, 76, 72, 73, 74, 77

[56] References Cited

U.S. PATENT DOCUMENTS

| | | | |
|---|---|---|---|
| 4,461,325 | 7/1984 | Palau et al | 139/66 R |
| 4,465,107 | 8/1984 | Epis | 139/66 R |
| 4,832,087 | 5/1989 | Palau et al. . | |
| 5,044,407 | 9/1991 | Vinciguerra | 139/66 A |

*Primary Examiner*—Andrew M. Falik
*Attorney, Agent, or Firm*—Dowell & Dowell

[57] ABSTRACT

In a weaving mechanism which includes rocking members for controlling the movement of heddle frames for forming the shed in weaving machines, the rocking members are separated from one another on a common support shaft by spacers interposed therebetween which spacer members are provided with projecting bosses which come into contact with bosses of adjacent spacer members. A rod cooperates with an arm of the spacers to insure the spacers are non-pivotably retained while the rocking members are moveable between the bosses extending therefrom.

10 Claims, 3 Drawing Sheets

SPACER DESIGN FOR DOBBY ROCKER MEMBERS

BACKGROUND OF THE INVENTION

1. Field of the Invention

The present invention relates to mechanisms for the formation of the shed in weaving machines. The term "mechanisms" embraces both dobbies of which the weaving program is capable of being easily modified, and simplified mechanisms incorporating cams or the like, which are purely repetitive.

2. History of the Related Art

It is known that, for individually maneuvering the different heddle frames mounted on the loom, such weaving mechanisms comprise an equal number of actuating assemblies (generally called "blades") which are disposed parallel to one another and each of which is formed by a series of rocking members which cooperate with one another to furnish, at the appropriate moment, which is a function of the weave desired for the fabric to be made, the force necessary for the vertical displacement of the corresponding heddle frame. The nature and form of these rocking members vary depending on the different types of mechanisms, however they are most often levers, rods or connecting rods, hooks, roller-holders, etc . . . which have a defined amplitude of pivotal movement. Of course, the identical rocking members of the different actuating assemblies are mounted on a common support shaft mounted in the frame of the weaving machine.

Certain of these rocking members, particularly the retaining hooks and the drawing levers coupled to the heddle frames, are subjected to a high degree of stress so that, to avoid any bending of the common support shafts, it is necessary to employ resistant pieces of large diameter, which because of their size are difficult to install in the frame of the mechanism.

In practice, different modes of mounting the rocking members on the common support shaft have been proposed, of which the three principal ones have been schematically illustrated in FIGS. 1 to 3 of the accompanying drawings.

The most simple assembly is that of FIG. 1, in which the fixed shaft 1 directly supports the rocking members 2 which are disposed side by side without any separation therebetween. Under the conditions, it is clear that these members 2 rub against one another. The frictional forces generated create overheating, substantial wear and defects in the weaving process.

The separated assembly of FIG. 2 was then proposed, in which the members 2, still directly engaged on the common shaft 1, are separated from one another by split rings or circlips 3, retained in grooves 1*a* machined in the wall of the shaft. In this way, mutual friction of the members 2 is avoided, but the production of the grooves 1*a* and the assembly of the rings 3 and the members 2 themselves substantially increase the machine cost, at the same time, the grooves 1*a* considerably weaken the resistance of the shaft 1 to bending.

In order to avoid these drawbacks, the solution illustrated in FIG. 3 has been employed, in which the separation of the rocking members 2 is ensured with the aid of shouldered rings 4 interposed between the support shaft 1 and the hub of each member. Assembly is simplified and the shaft 1 conserves its full resistance, but the rings 4 must be made of special, therefore expensive, metals or alloy in order to resist friction. Furthermore and in particular, area of frictional resistance is increased and, in order to avoid poor performance in the weaving mechanism, the diameter of shaft 1 must be decreased, thus reducing its bending strength.

It is an object of the present invention to overcome these drawbacks, with the aid of a solution which allows the hub of the rocking members to rub directly on a smooth-walled shaft, without any groove, and which nonetheless ensures separation of the members and preventing any mutual lateral friction therebetween.

SUMMARY OF THE INVENTION

The invention relates to a weaving mechanism for the formation of the shed on weaving machines, of the type for maneuvering the heddle frames which are coupled thereto which includes a corresponding number of actuating assemblies oriented parallel to one another and of which each is formed by a series of rocking members (levers, rods, hooks, roller-holders, etc . . . ) mounted side by side on common support shafts, being, however, separated from one another to avoid any lateral friction therebetween. The rocking members are separated by annular spacers which are engaged on the support shaft between said members and which include, on at least one of their lateral faces, projecting bosses adapted to come into contact with adjacent spacers thus defining between the two spacers a free space sufficient for the rocking member.

BRIEF DESCRIPTION OF THE DRAWINGS

The invention will be more readily understood on reading the following description with reference to the accompanying drawings, in which.

As indicated in the preamble.

DETAILED DESCRIPTION OF THE DRAWINGS

Figure 1:
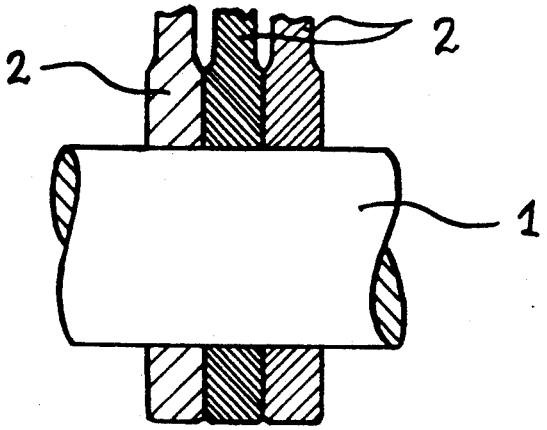
Fig. 1 PRIOR ART
FIGS. 1 to 3 are schematic sections illustrating three prior known solutions.
Figure 2:
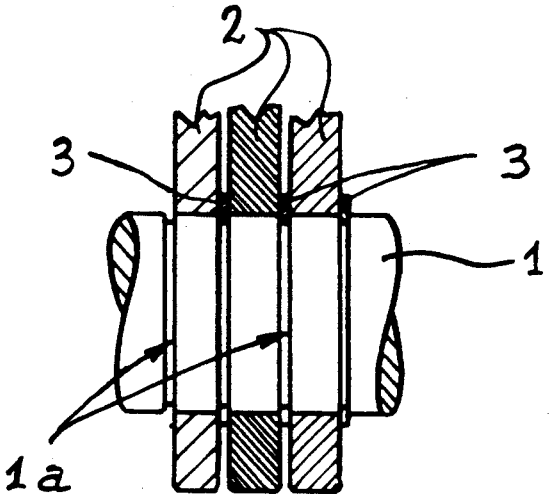
Fig. 2 PRIOR ART
Figure 3:
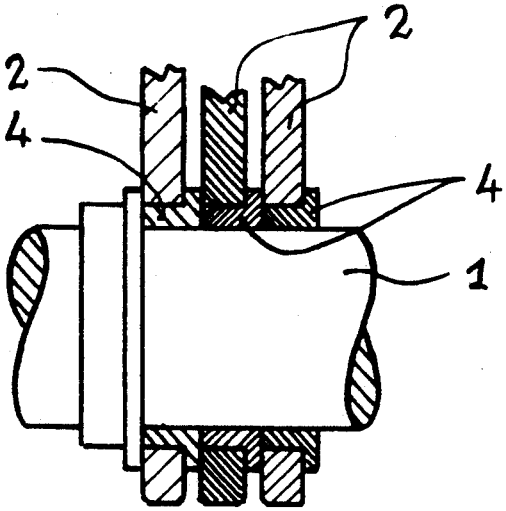
Fig. 3 PRIOR ART
Figure 4:
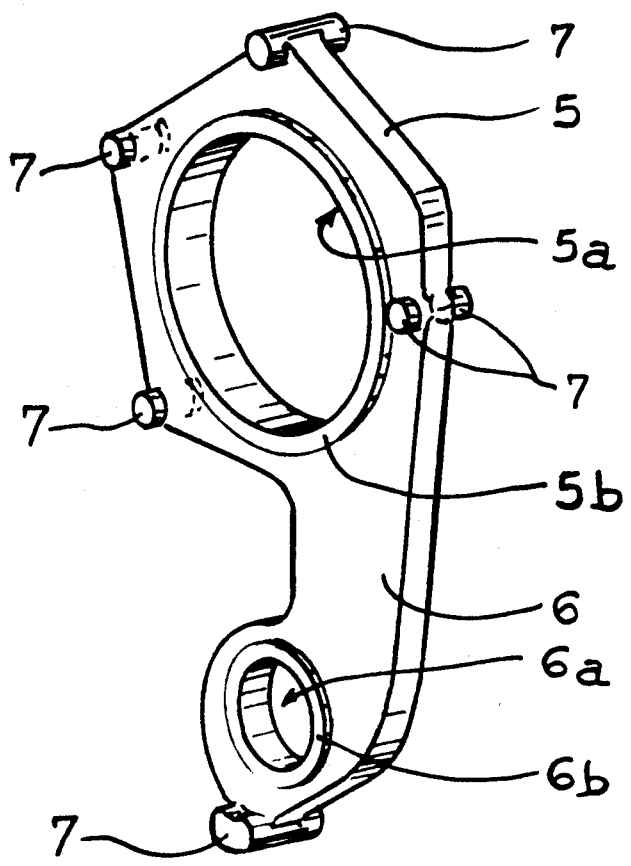
FIG. 4 is a view in perspective of one of the spacers for a weaving mechanism according to the present invention.

Referring again to the drawings, FIG. 4 shows at 5 a spacer which is provided with an opening 5*a* defined by annular projection hubs 5*b* which are provided on each of the lateral faces of the spacer. The spacer 5 is extended by an arm 6 which is provided at 6*a* with an opening having a diameter clearly smaller than that of opening 5*a*. The opening 6*a* is also defined by two opposite annular projections 6*b*.

The spacer thus sectioned, includes a series of bosses 7 which laterally project on the opposite faces thereof. The bosses extend outwardly from the lateral faces a greater distance than the annular projections. In the embodiment shown, it has been assumed that the spacer 5 includes four projecting bosses 7 adjacent opening 5*a*, while arm 6 only includes one boss.

Figure 5:
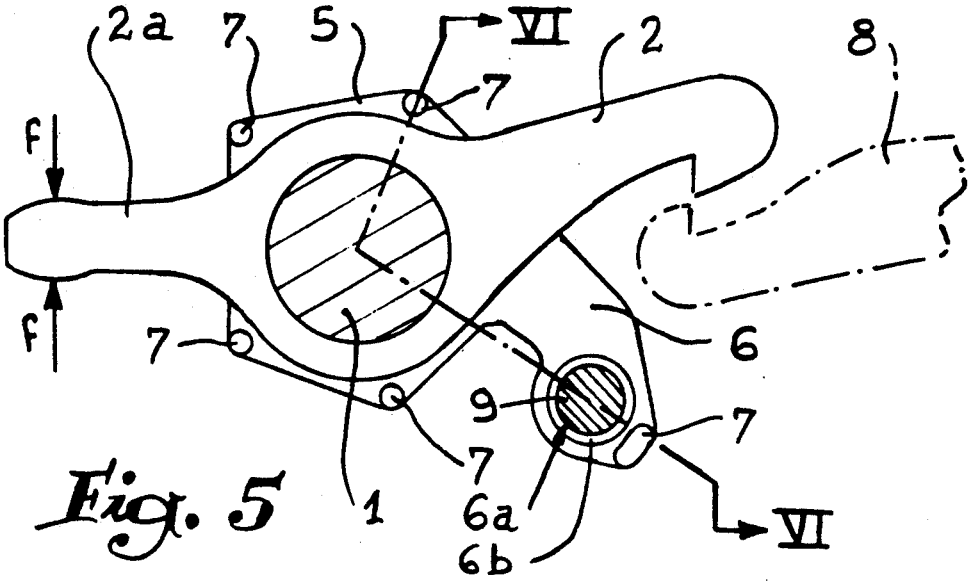
FIG. 5 is a transverse section showing the assembly of a rocking member between two spacers according to FIG. 4.
Figure 6:
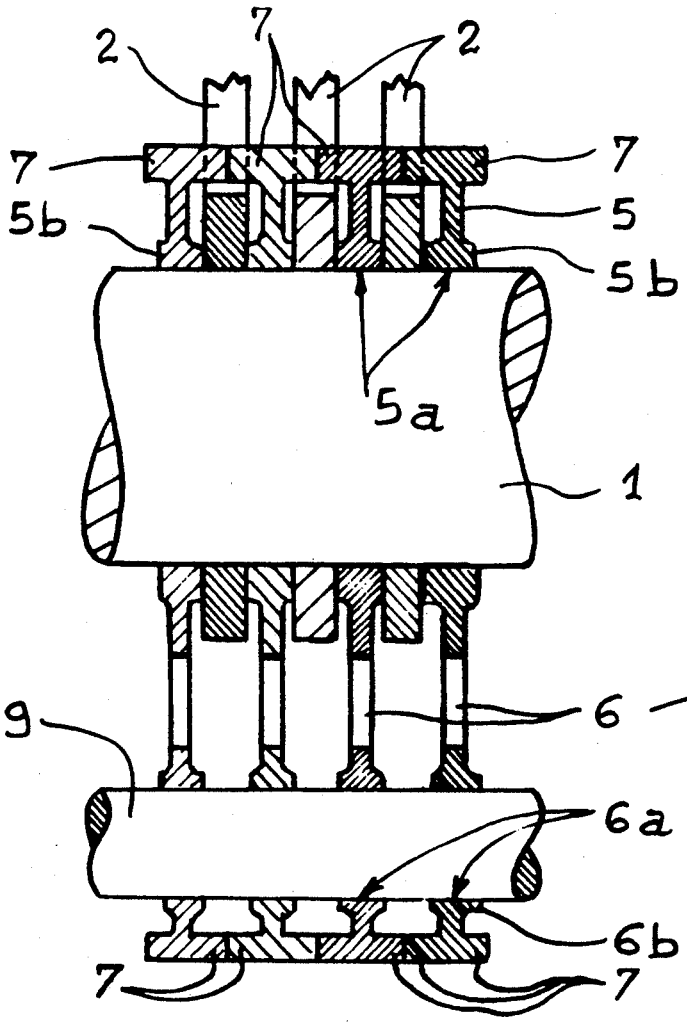
FIG. 6 is a partial section along plane VI—VI of FIG. 5.

FIGS. 5 and 6 clearly show the assembly of spacers 5 and the rocking members 2 on the common support shaft 1. In the case shown, the members 2 are constituted by hooks which, under the action of the reading device of the mechanism (action which is represented in the form of opposite arrows f), are intended to be coupled with corresponding fixed hooks 8, or to escape them, and this by a pivoting motion of reduced angular amplitude.

Between two adjacent members or hooks 2 is interposed a spacer of which the arm 6 is engaged by its opening 6a on a rod 9 fixed in the frame of the weaving mechanism and oriented parallel to shaft 1. The position of rod 9 is such that the spacer 5 is retained angularly so that the principal part of the hooks 2 and their actuating shank 2a are disposed between the bosses 7 and thus are free to pivot therebetween. Bosses 7 of two contiguous spacers may consequently come into contact, ensuring correct spacing of the hooks 2.

Each rocking member or hook 2 rubs directly on the support shaft 1 which is provided with a smooth wall. The assembly of these hooks and spacers on the shaft 1 is not difficult and may be effected with the aid of a simple, high-yield automatic machines.

The number of bosses 7, their arrangement and cross section may vary to a very broad extent.

In particular, taking into account the saving of space obtained diametrically at the hub of each rocking member 2, there may be interposed between the hub and the support shaft 1, a ball or needle bearing adapted to improve rotation. Moreover, it goes without saying that the bosses 7 of each spacer are capable of extending only on one face thereof, as long as they are sufficiently long to bear against the smooth face of the adjacent spacer.

What is claimed is:

1. In a weaving mechanism for forming the shed on a weaving machine which mechanism includes rocking members oriented parallel to one another on a common support shaft for controlling the movement of heddle frames, the improvement comprising, the rocking members being separated by spacer means which are freely mounted to the common support shaft and between each of the rocking members, each spacer means including a body portion having oppositely oriented lateral faces, a plurality of spaced projections extending from at least one of said lateral faces of each of said spacer means, said projections being engageable with an adjacent spacer means to thereby retain said body portions of said spacer means in spaced relationship with respect to one another and to define spaces between the projections through which the rocking members extend, said rocking members being moveable between said body portions of adjacent spacer means while being maintained in spaced relationship with respect to one another.

2. The weaving mechanism of claim 1 including means for retaining each of said spacer means in non-movable relationship with respect to the common support shaft.

3. The weaving mechanism of claim 2 in which each of said body portions of said spacer means includes an arm portion having an opening therein, said means for retaining said spacer means including a rod means adapted to be fixed to the weaving machine and extending parallel to the common support shaft, said rod means extending through said opening in said arm portion of said spacer means.

4. The weaving mechanism of claim 2 in which said body portion of each of said spacer means includes an enlarged opening for receiving the common support shaft therethrough, an annular projection extending outwardly from each of said lateral faces in surrounding relationship with respect to said enlarged opening, and said projections extending outwardly from said at least one of said lateral faces a greater distance than said annular projection.

5. The weaving mechanism of claim 4 in which said spacer members include a plurality of projections extending outwardly from each of said lateral faces thereof, said projections being engageable with projections of an adjacent spacer means.

6. The weaving mechanism of claim 3 in which said spacer members include a plurality of projections extending outwardly from each of said lateral faces thereof, said projections being engageable with projections of an adjacent spacer means.

7. The weaving mechanism of claim 3 in which said body portion of each of said spacer means includes an enlarged opening spaced from said arm portion for receiving the common support shaft therethrough, a first annular projection extending outwardly from each of said lateral faces in surrounding relationship with respect to said enlarged opening, and said projections extending outwardly from said at least one of said lateral faces a greater distance than said first annular projection.

8. The weaving mechanism of claim 7 including a second annular projection extending outwardly from each of said lateral faces in surrounding relationship to said opening in said arm portion.

9. The weaving mechanism of claim 8 in which said spacer members include a plurality of projections extending outwardly from each of said lateral faces thereof, said projections being engageable with projections of an adjacent spacer means.

10. The weaving mechanism of claim 1 in which said spacer members include a plurality of projections extending outwardly from each of said lateral faces thereof, said projections being engageable with projections of an adjacent spacer means.

* * * * *